US009637290B2

(12) United States Patent
Jeon

(10) Patent No.: US 9,637,290 B2
(45) Date of Patent: May 2, 2017

(54) CAPSULE CAP FOR BEVERAGE CONTAINER

(71) Applicants: CHUNG A RAM CO., LTD., Eumseong-gun (KR); Young-bok Jeon, Incheon (KR)

(72) Inventor: Young-bok Jeon, Incheon (KR)

(73) Assignees: CHUNG A RAM CO., LTD., Eumseong-Gun (KR); Young-Bok Jeon, Incheon (KR)

( * ) Notice: Subject to any disclaimer, the term of this patent is extended or adjusted under 35 U.S.C. 154(b) by 0 days.

(21) Appl. No.: 15/032,104

(22) PCT Filed: Dec. 20, 2013

(86) PCT No.: PCT/KR2013/011942
§ 371 (c)(1),
(2) Date: Apr. 26, 2016

(87) PCT Pub. No.: WO2015/064836
PCT Pub. Date: May 7, 2015

(65) Prior Publication Data

US 2016/0264323 A1 Sep. 15, 2016

(30) Foreign Application Priority Data

Oct. 28, 2013 (KR) ..... 10-2013-0128262

(51) Int. Cl.
*B65D 25/40* (2006.01)
*B65D 51/28* (2006.01)
*B65D 51/24* (2006.01)

(52) U.S. Cl.
CPC ..... *B65D 51/285* (2013.01); *B65D 51/243* (2013.01)

(58) Field of Classification Search
CPC ..... B65D 5/747; B65D 5/748; B65D 25/40
USPC ..... 206/219, 222; 220/255.1; 222/80, 83, 222/83.5
See application file for complete search history.

(56) References Cited

U.S. PATENT DOCUMENTS 6,398,075 B1 * 6/2002 Laciacera ..... B65D 5/748 222/83
6,851,576 B2 * 2/2005 Dubach ..... B65D 5/748 220/277
7,036,683 B2 * 5/2006 Dubach ..... B65D 5/748 222/83

(Continued)

FOREIGN PATENT DOCUMENTS

JP 2000-095278 4/2000
JP 2011-140352 7/2011
KR 10-2006-0006698 1/2006

*Primary Examiner* — King M Chu
(74) *Attorney, Agent, or Firm* — Lex IP Meister, PLLC

(57) ABSTRACT

A capsule cap for a beverage container of the present invention includes: a cylindrical lower coupling unit (10) keeping an additive (A) therein; a cutting unit (20) having a cylindrical cutting body (21) inserted in a lower body (11) and vertically moving down to cut a seal (12) so that the additive (A) drops; and an upper coupling unit (30) disposed over the lower coupling unit (30) to be turned and vertically move the cutting unit (20), in which drinking water contained in the beverage container an additive are separately kept, so the drinking water and the additive are prevented from spoiling. Further, spiral guides are formed, so torque is easily changed into straight force, thereby achieving easy cutting and opening.

8 Claims, 5 Drawing Sheets

(56) References Cited

U.S. PATENT DOCUMENTS

| | | | | |
|---|---|---|---|---|
| 7,207,465 | B2 * | 4/2007 | Weist | B65D 5/748 222/83 |
| 7,458,486 | B2 * | 12/2008 | Weist | B65D 5/748 220/278 |
| 7,886,922 | B2 * | 2/2011 | Seelhofer | B65D 5/748 215/249 |
| 7,959,032 | B2 * | 6/2011 | Bolli | B65D 5/748 220/277 |
| 8,372,328 | B2 * | 2/2013 | Dubach | B29C 45/006 215/225 |
| 8,505,760 | B2 * | 8/2013 | Ott | B65D 5/748 215/253 |
| 8,672,167 | B2 * | 3/2014 | Leuenberger | B65D 5/748 220/267 |
| 8,720,744 | B2 * | 5/2014 | Barron | B65D 51/221 220/278 |
| 9,126,731 | B2 * | 9/2015 | Chen | B65D 51/2835 |
| 2008/0210745 | A1 * | 9/2008 | Rigling | B65D 5/748 229/125.04 |
| 2009/0302037 | A1 * | 12/2009 | Rigling | B65D 5/748 220/258.4 |
| 2010/0018992 | A1 * | 1/2010 | Dill | B65D 5/747 222/83 |
| 2010/0237073 | A1 * | 9/2010 | Alther | B65D 5/748 220/258.4 |
| 2011/0168659 | A1 * | 7/2011 | Hsieh | B65D 51/2835 215/250 |
| 2012/0181281 | A1 * | 7/2012 | Ott | B65D 5/748 220/277 |

* cited by examiner

CAPSULE CAP FOR BEVERAGE CONTAINER

TECHNICAL FIELD

The present invention relates to a capsule cap for a beverage container and, more particularly, to a capsule cap for a beverage container that separately keeps an additive to be mixed and drinking water in the beverage container to prevent the drinking water and the additive from spoiling, can simply provide various beverages by changing the cap, allows for opening the beverage container and dropping the additive at the same time by changing torque into straight force using spiral guides, and increases pressing force of a cutting unit by forming a vertical guide groove at the cutting unit.

BACKGROUND ART

Recently, the social life patterns of people have become busy and many functional beverages such as coffee, teas, and vitamin beverages that can be simply consumed are on the market, so capsule caps that have a space for keeping an additive, such as vitamin powder, a fruit concentrate, a coffee concentrate, or liquid-state drug, and an opener for opening the space so that customers can add the additive to a beverage and drink the mixture according to their preference have been developed.

For example, a beverage bottle with a capsule cap has been disclosed in Korean Patent Application Publication No. 10-2012-0064878 and FIG. 1 is a cross-sectional view showing a capsule cap of the related art.

The beverage bottle with a capsule cap of the related art, as shown in FIG. 1, includes a push portion 3*a* that has a relatively small thickness and is formed at the center of a cap 3 on the beverage bottle, a sheet cutting pin 3*b* that protrudes downward at the center of the bottom of the push portion 3*a*, a cylindrical additive housing 3*c* that accommodates the sheet cutting pin 3*b* and keeps an additive A, and a sealing sheet 3*d* that holds the additive at the bottom of the additive housing 3*c* and is cut by the sheet cutting pin 3*b*, so when the push portion 3*a* is pressed, the sheet cutting pin 3*b* cuts the sealing sheet 3*d* and accordingly the additive A drops into the beverage bottom B.

However, according to the capsule cap, the push portion 3*a* exposed to the outside is frequently unexpectedly pressed, and the sealing sheet 3*d* of the cap 3 is made of a thin material to be punctured even due to slight downward movement of the sheet cutting pin 3*b*, so it is easily torn by external shock and the additive is unexpectedly added to the beverage. Therefore, customers have to be careful when carrying a bottle with such a cap.

Further, the capsule cap of the related art is fitted on the beverage bottle B through a process at high temperature and high pressure to prevent the drinking water W contained in the beverage bottle B from spoiling, but there is a problem that the sealing sheet 3*d* of the capsule cap cannot resist the high pressure and high temperature and is consequently separated.

Accordingly, in order to solve the problem with the capsule cap of the related art, a technology of preventing the sealing sheet 3*d* from being easily separated due to external shock by making the sealing sheet 3*d* thick or integrally forming the sealing sheet 3*d* on the bottom of the additive housing 3*c* has been developed, but the sealing sheet 3*d* is not easily separated and the additive A is not mixed to the beverage due to the increased thickness in many cases.

Further, a way of cutting the edge of the thick sealing sheet 3*d* of the capsule cap of the related art by turning the sealing sheet 3*d* to easily separate it has been proposed, but if a powder type additive is kept in the capsule cap, the additive is spoiled due to friction between the powder and a cutting blade when the sealing sheet 3*d* is turned, and cutting is also difficult.

DISCLOSURE

Technical Problem

The present invention has been made in an effort to remove the problems in the related art and an object of the present invention is to provide a capsule cap for a beverage container that prevents an additive to be mixed and drinking water in the beverage container from spoiling by separately keeping the drinking water and the additive; can simply provide various beverages by changing the cap; allows for opening the beverage container and dropping the additive at the same time by changing torque into straight force using spiral guides; increases pressing force of a cutting unit by forming a vertical guide groove at the cutting unit; completely seals the additive by fitting the cutting unit in the upper body; and prevents the cutting unit from separating by fitting the cutting unit in the lower body when a user desired to drink the drinking water.

Technical Solution

A capsule cap for a beverage container according to an aspect of the present invention, which seals a beverage container and allows a user to add an additive kept inside the cap, such as powder or an undiluted solution according to his/her preference, when the user desires to drink drinking water contained in the beverage container, includes: a lower coupling unit composed of a cylindrical lower body having a seal for sealing the bottom of the lower body to keep an additive therein and a cup-shaped container coupling portion formed on the outer side of the lower body and having a thread around the inner side to be coupled to the entrance of the beverage container; a cutting unit composed of a cylindrical cutting body inserted in the lower body, a cutter formed at a predetermined angle at the lower portion of the cutting body to press and cut a side of the seal, and a cutting guide spirally formed around the outer side of the cutting body; and an upper coupling unit disposed over the lower coupling unit and composed of an upper pressing guide formed in the same shape as the spiral shape of the cutting guide and a cup-shaped upper body having a thread around the inner side to be coupled to the upper portion of the lower body.

A cutting unit guide groove may be vertically formed on an inner side of the lower body, and a cutting unit guide projection for vertically moving the cutting unit inserted in the cutting unit guide groove may be formed on the outer side of the cutting body.

An upper body-pressing projection that protrudes outward may be formed around an outer side of an upper portion of the cutting body so that the cutting unit is fitted inside the upper body.

The seal may be integrally formed on an inner side of the lower body and a cutting portion that is relatively thin to be easily cut by the cutter may be formed around an edge of the seal.

A crease may be formed at a portion of the edge of the seal so that the seal folds down after being cut along a predetermined portion.

An inserting portion may be formed at a lower portion of the lower body to be smaller than a diameter of the lower body so that the lower coupling unit can be easily inserted into the entrance of the beverage container.

A cutting unit-pressing projection that protrudes inward may be formed on an inner side of the lower body to prevent the cutting unit from separating outside by pressing the cutting unit.

An anti-contact groove may be formed upward at the cutter to prevent contact with a side of the seal.

Advantageous Effects

Effects of the capsule cap for a beverage container according to the present invention are as follows.

First, since drink water in a beverage container and an additive to be mixed are separately kept, it is possible to prevent the drinking water and the additive from spoiling by coming in contact with the external air, so a keeping ability can be greatly improved.

Second, it is possible to simply enjoy various beverages without changing the drinking water itself in the beverage container by changing the lower coupling unit that seals the upper portion of the beverage container and keeps an additive therein, according to preference.

Third, since a spiral upper pressing guide is formed at an upper coupling unit and a spiral cutting guide is formed at a cutting unit, an additive can be dropped with opening of the upper coupling unit, so convenience for a user can be considerably improved.

Fourth, a cutting unit guide groove is vertically formed on the inner side of a lower body and a cutting unit guide projection that is inserted in the cutting unit guide groove is formed, whereby the cutting unit can vertically move without turning even though the upper coupling unit is turned, so cutting can be easily performed.

Fifth, since an upper body-pressing projection that protrudes outward is formed to fit the cutting unit in the upper body, it is possible to prevent an additive in the lower body from spoiling by completely isolating the additive from the external air.

Sixth, since a cutting unit-pressing projection that protrudes inward is formed on the inner side of the lower body to prevent the cutting unit from separating outside by pressing it, it is possible to prevent the cutting unit from separating from the lower coupling unit when a user drinks the drinking water after opening the upper coupling unit.

Seventh, since a cutting portion that is relatively thin to be easily cut by the cutter is formed around the edge of a seal, the seal can be easily cut when the cutter 22 is pressed down.

Eighth, since a crease is formed at a portion of the edge of the seal so that the seal folds down after being cut along a predetermined portion, the seal folds after being cut, so the additive can be easily dropped.

Ninth, since an anti-contact groove is formed upward to prevent the cutting unit from coming in contact with a side of the seal, the entire edge of the seal is prevented from being cut, so it is possible to prevent the seal from dropping into drinking water.

MODE FOR INVENTION

Hereinafter, an embodiment of the present invention will be described in detail with reference to the accompanying drawings.

Figure 1:
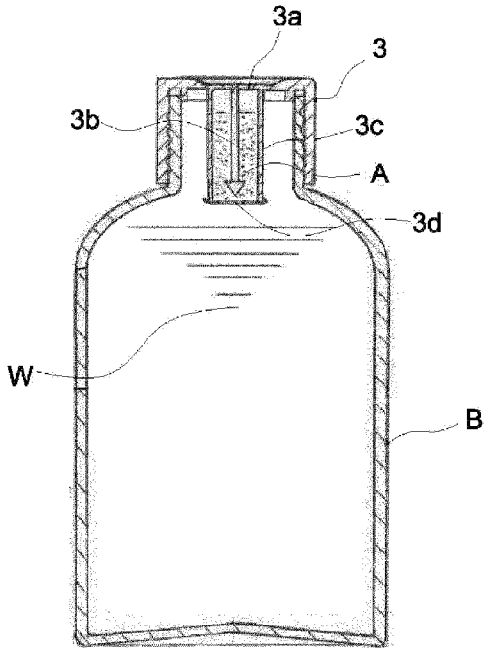
FIG. 1 is a cross-sectional view showing a capsule cap for a beverage container of the related art.
Figure 2:
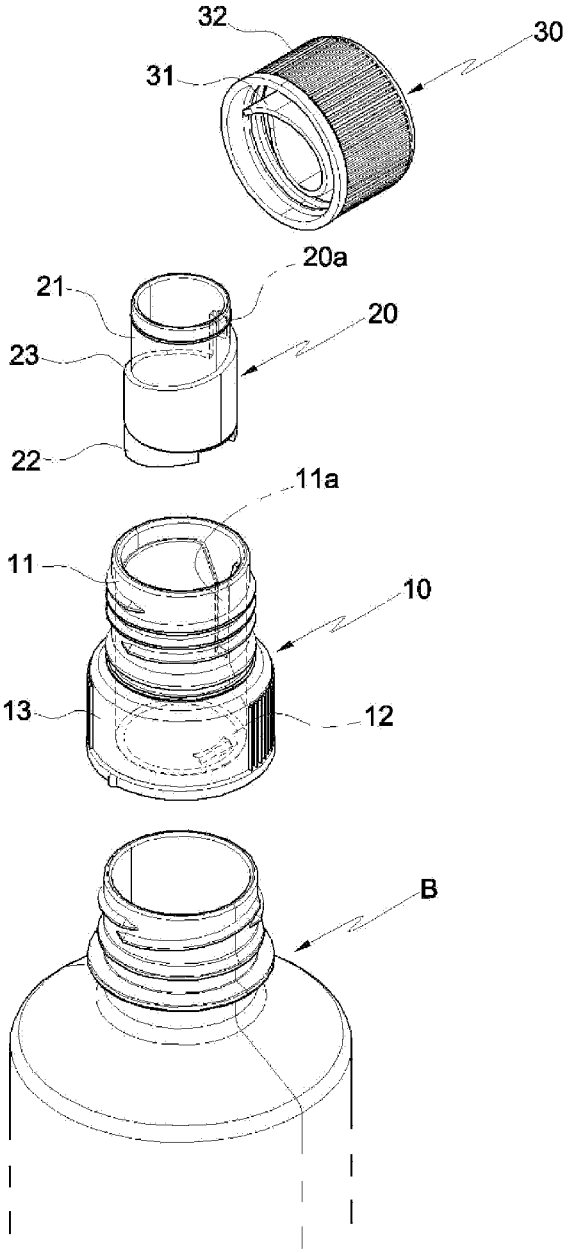
FIG. 2 is an exploded perspective view showing a capsule cap for a beverage container.

A capsule cap for a beverage container of the present invention that seals a beverage container B and allows a user to add an additive A kept inside the cap, such as powder or an undiluted solution according to his/her preference, when the user desired to drink drinking water W contained in the beverage container B, as shown in FIG. 2, includes: a lower coupling unit 10 composed of a cylindrical lower body 11 having a seal 12 for sealing the bottom of the lower body 11 to keep an additive therein and a cup-shaped container coupling portion 13 formed on the outer side of the lower body 11 and having a thread around the inner side to be coupled to the entrance of the beverage container B; a cutting unit 20 composed of a cylindrical cutting body 21 inserted in the lower body 11, a cutter 22 formed at a predetermined angle at the lower portion of the cutting body 21 to press and cut a side of the seal 12, and a cutting guide 23 spirally formed around the outer side of the cutting body 21; and an upper coupling unit 30 disposed over the lower coupling unit 10 and composed of an upper pressing guide 31 formed in the same shape as the spiral shape of the cutting guide 23 and a cup-shaped upper body 32 having a thread around the inner side to be coupled to the upper portion of the lower body 11.

The container coupling portion 13 extends downward from the middle portion of the outer side of the lower body 11 and a thread (not shown) to be fitted to the thread on the inner side of the container coupling portion 13 may be formed at the entrance of the beverage container B.

A cutting unit guide groove 11*a* is vertically formed on the inner side of the lower body 11 and a cutting unit guide projection 20*a* for vertically moving the cutting unit 20 inserted in the cutting unit guide groove 11*a* is formed on the outer side of the cutting body 21.

Figure 3:
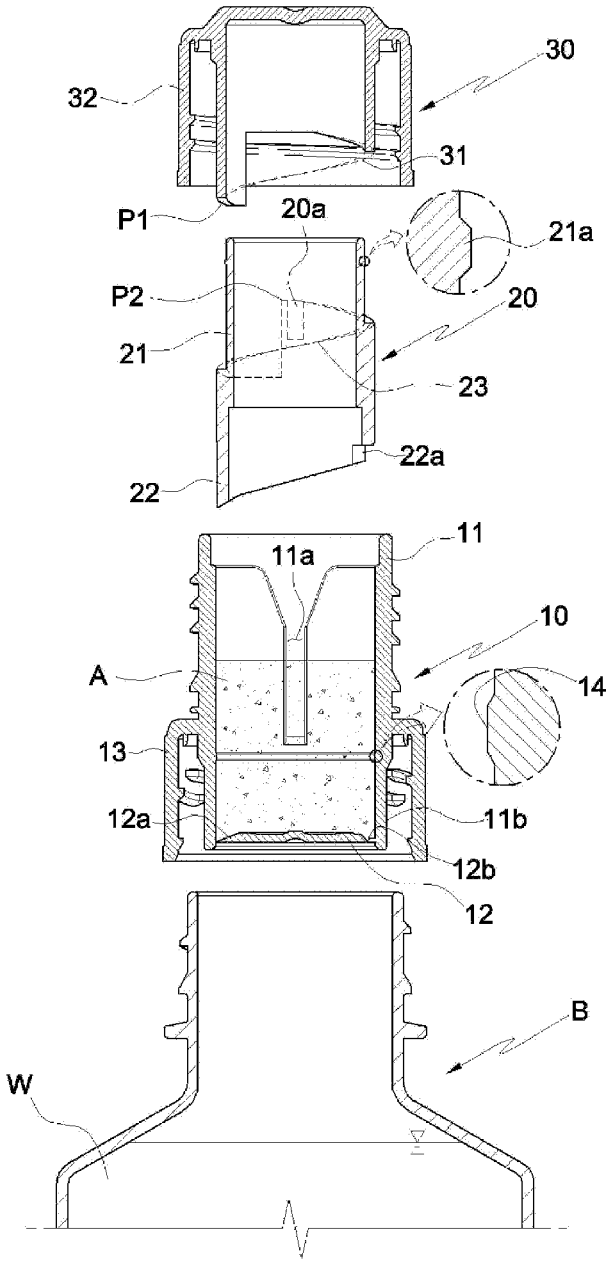
FIG. 3 is an exploded cross-sectional view showing the capsule cap for a beverage container.

Further, as shown in FIG. 3, an upper body-pressing projection 21*a* that protrudes outward is formed around the outer side of the upper portion of the cutting body 21 so that the cutting unit 20 is fitted inside the upper body 32.

The upper body-pressing projection 21*a* may be formed larger than the inner diameter of the upper body 32.

The seal 12 is integrally formed on the inner side of the lower body 11 and a cutting portion 12*a* that is relatively thin to be easily cut by the cutter 22 is formed around the edge of the seal 12.

A crease 12*b* is formed at a portion of the edge of the seal 12 so that the seal 12 folds down after being cut along a predetermined portion.

An inserting portion 11*b* is formed at the lower portion of the lower body 11 to be smaller than the diameter of the lower body 11 so that the lower coupling unit 10 can be easily inserted into the entrance of the beverage container B.

A cutting unit-pressing projection 14 that protrudes inward is formed on the inner side of the lower body 11 to prevent the cutting unit 20 from separating outside by pressing it.

The inner diameter of the cutting unit-pressing projection 14 may be larger than the outer diameter of the cutting unit 20.

An anti-contact groove 22*a* is formed upward at the cutter 22 to prevent contact with a side of the seal 12, as shown in FIG. 2.

Operation of the capsule cap for a beverage container that has the configuration described above is described hereafter.

According to the capsule cap for a beverage container of the present invention, the lower coupling unit 10 coupling to the beverage container B and keeping an additive A therein, the cutting unit 20 inserted in the lower coupling unit 10 to cut the seal 12 holding the additive A, and the upper coupling unit 30 closing the top of the lower coupling unit 10 and pressing down the cutting unit 20 are combined, so that interaction of these three units allows a user to add the additive A to drinking water W in the beverage container B and drink the mixture according to his/her preference.

Figure 4:
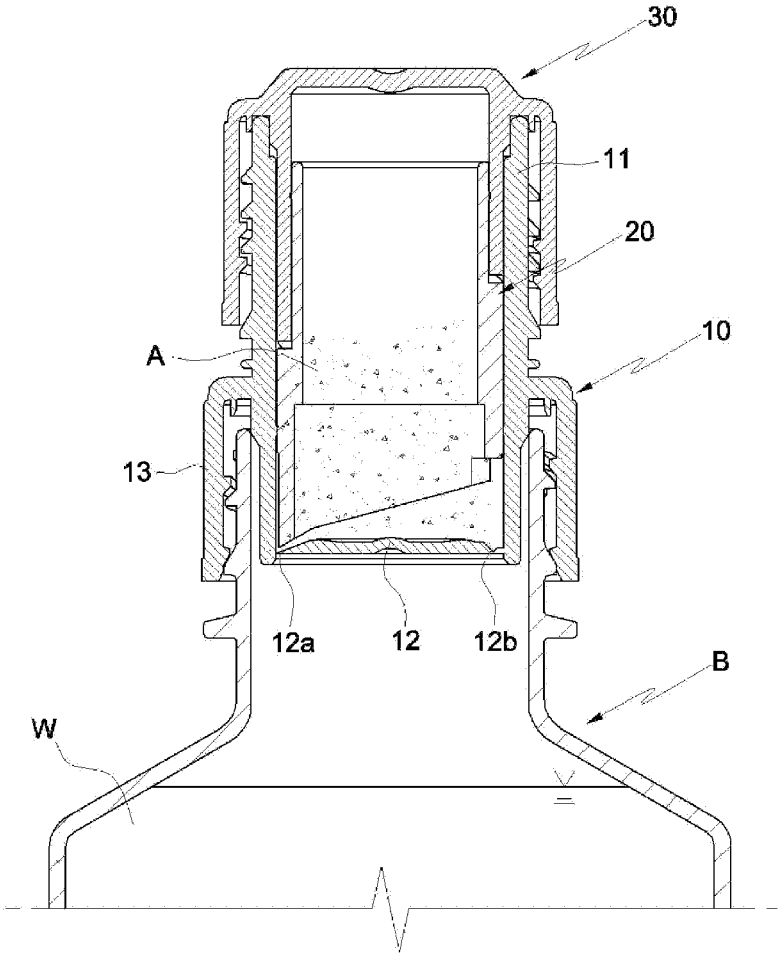
FIG. 4 is a cross-sectional assembly view showing the initial state when the capsule cap for a beverage container of the present invention is mounted.
Figure 5:
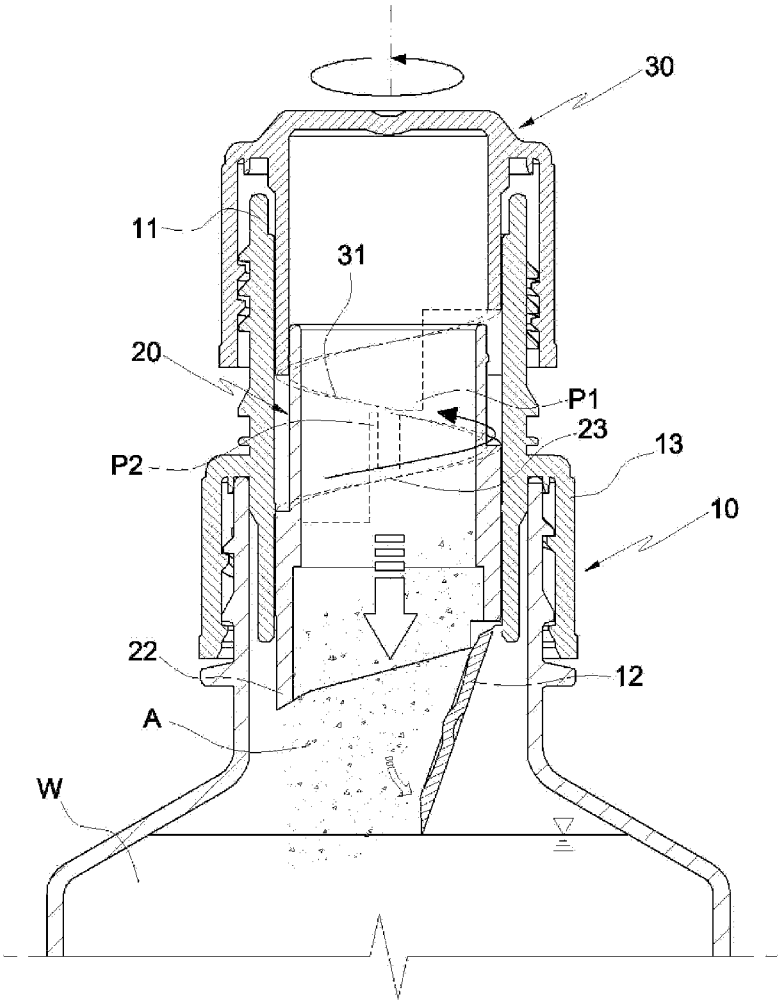
FIG. 5 is a view showing that an additive in the capsule cap for a beverage container of the present invention is added.

That is, as shown in FIGS. 3 to 5, the beverage container B is first filled with drinking water W, the drinking water W is completely isolated from the outside by coupling the lower coupling unit 10 to the upper portion of the beverage container B, and then one of various additives A such as powder or an undiluted solution to be mixed and drunk with the drinking water W is put into the lower coupling unit 10 separately from the drinking water W. Accordingly, it is possible to prevent the drinking water W and the additive A from spoiling by coming in contact with the external air, so a keeping ability can be greatly improved.

Further, it is possible to simply enjoy various beverages without changing the drinking water W itself in the beverage container B by changing the lower coupling unit 10 sealing the upper portion of the beverage container B and filled with the additive A.

When the cutting unit 20 inserted in the lower coupling unit 10 is vertically moved down and cuts the edge of the seal 12 inside the lower coupling unit 10 to drop the additive in the lower coupling unit 10 into the drinking water W, the additive A in the lower coupling unit 10 can be dropped into and mixed with the drinking water W in the beverage container B.

When the upper coupling unit 30 is turned opposite to the coupling direction, as shown in FIG. 5, the bottom end P1 of the spiral upper pressing guide 31 slides to the top end P2 of the spiral cutting guide 23 and the cutting unit 20 is vertically moved down, so the additive A can be dropped with opening of the upper coupling unit 30.

Further, since the cutting unit guide groove 11*a* is vertically formed on the inner side of the lower body 11 and the cutting unit guide projection 20*a* is formed on the outer side of the cutting body 21 to be inserted in the cutting unit guide groove 11*a*, as shown in FIG. 3, even though the upper coupling unit 30 is turned, the cutting unit 20 being in contact with the upper coupling unit 30 can vertically move without turning.

Further, since the upper body-pressing projection 21*a* protruding outward is formed around the outer side of the upper portion of the cutting body 21 so that the cutting unit 20 is fitted inside the upper body 32, as shown in FIGS. 3 to 5, it is possible to completely seal the additive A in the cutting unit 20 from the external air.

Further, since the cutting unit-pressing projection 14 protruding inward is formed on the inner side of the lower body 11 to prevent the cutting unit 20 from separating outside by pressing it, it is possible to prevent the cutting unit 20 from separating from the lower coupling unit 10 when a user drinks the drinking water after opening the upper coupling unit 30.

Further, since the seal 12 is integrally formed on the inner side of the lower body 11 and a cutting portion 12*a* that is relatively thin to be easily cut by the cutter 22 is formed around the edge of the seal 12, the seal 12 can be easily cut when the cutter 22 is pressed down.

Further, since the crease 12*b* is formed at a portion of the edge of the seal 12 so that the seal 12 folds down after being cut along a predetermined portion, the seal 12 folds after being cut, so the additive A can be easily dropped.

Further, since the anti-contact groove 22*a* is formed upward at the cutter 22 to prevent contact with a side of the seal 12, as shown in FIG. 2, it is possible to prevent the entire edge of the seal 12 from being cut.

The present invention is not limited to the embodiments described above and may be changed and modified in various way by those skilled in the art without departing from the scope of the present invention, and the modifications are included in claims.

<Description of the Reference Numerals in the Drawings>

| | |
|---|---|
| 10: Lower coupling unit | 11: Lower body |
| 11a: Cutting unit guide groove | 11b: Inserting portion |
| 12: Seal | 12a: Cutting portion |
| 12b: Crease | |
| 13: Container coupling portion | |
| 14: Cutting unit-pressing projection | |
| 20: Cutting unit | |
| 20a: Cutting unit guide projection | |
| 21: Cutting body | |
| 21a: Upper body-pressing projection | 22: Cutter |
| 22a: Anti-contact groove | 23: Cutting guide |
| 30: Upper coupling unit | |
| 31: Upper pressing guide | 32: Upper body |
| P1: Bottom end | P2: Top end |
| B: Beverage container | W: Beverage |
| A: Additive | |

The invention claimed is:

1. A capsule cap for a beverage container that seals a beverage container (B) and allows a user to mix an additive (A) kept inside the cap, such as powder or an undiluted solution, when the user desired to drink drinking water (W) contained in the beverage container (B), the capsule cap comprising:

a lower coupling unit (10) composed of a cylindrical lower body (11) having a seal (12) for sealing a bottom of the lower body (11) to keep the additive (A) therein and a cup-shaped container coupling portion (13) formed on an outer side of the lower body (11) and having a thread around an inner side to be coupled to an entrance of the beverage container (B);

a cutting unit (20) composed of a cylindrical cutting body (21) inserted in the lower body (11), a cutter (22) formed at a predetermined angle at a lower portion of the cutting body (21) to press and cut a side of the seal (12), and a cutting guide (23) spirally formed around an outer side of the cutting body (21); and an upper coupling unit (30) disposed over the lower coupling unit (10) and composed of an upper pressing guide (31) formed in the same shape as the spiral shape of the cutting guide (23) and a cup-shaped upper body (32) having a thread around an inner side thereof to be coupled to an upper portion of the lower body (11).

2. The capsule cap of claim 1, wherein a cutting unit guide groove (11*a*) is vertically formed on an inner side of the lower body (11), and a cutting unit guide projection (20*a*) for vertically moving the cutting unit (20) inserted in the cutting unit guide groove (11*a*) is formed on the outer side of the cutting body (21).

3. The capsule cap of claim 1, wherein an upper body-pressing projection (21*a*) that protrudes outward is formed around an outer side of an upper portion of the cutting body (21) so that the cutting unit (20) is fitted inside the upper body (32).

4. The capsule cap of claim 1, wherein the seal (12) is integrally formed on an inner side of the lower body (11) and a cutting portion (12*a*) that is relatively thin to be easily cut by the cutter (22) is formed around an edge of the seal (12).

5. The capsule cap of claim 1, wherein a crease (12*b*) is formed at a portion of the edge of the seal (12) so that the seal (12) folds down after being cut along a predetermined portion.

6. The capsule cap of claim 1, wherein an inserting portion (11*b*) is formed at a lower portion of the lower body (11) to be smaller than a diameter of the lower body (11) so that the lower coupling unit (10) can be easily inserted into the entrance of the beverage container (B).

7. The capsule cap of claim 1, wherein a cutting unit-pressing projection (14) that protrudes inward is formed on an inner side of the lower body (11) to prevent the cutting unit (20) from separating outside by pressing the cutting unit (20).

8. The capsule cap of claim 1, wherein an anti-contact groove (22*a*) is formed upward at the cutter (22) to prevent contact of a side with the seal (12).

* * * * *